US006485234B2

(12) United States Patent
Johnson

(10) Patent No.: US 6,485,234 B2
(45) Date of Patent: Nov. 26, 2002

(54) APPARATUS AND METHOD FOR MAKING CYLINDRICAL COLUMNS

(75) Inventor: James O. Johnson, Walnut Creek, CA (US)

(73) Assignee: Condon-Johnson & Associates, Inc., Oakland, CA (US)

( * ) Notice: Subject to any disclaimer, the term of this patent is extended or adjusted under 35 U.S.C. 154(b) by 0 days.

(21) Appl. No.: 09/735,687

(22) Filed: Dec. 12, 2000

(65) Prior Publication Data

US 2002/0071726 A1 Jun. 13, 2002

(51) Int. Cl.[7] ..... E02D 5/31; E21B 7/26

(52) U.S. Cl. ..... 405/233; 172/25; 175/21; 175/64; 405/241; 405/268; 405/269

(58) Field of Search ..... 172/25; 405/232, 405/233, 239–242, 268, 269; 175/19, 21, 64, 72; 173/136, 138

(56) References Cited

U.S. PATENT DOCUMENTS 3,436,921 A * 4/1969 Gauntt, Jr. et al. ..... 405/249
3,499,293 A * 3/1970 Kato ..... 175/195
5,304,016 A * 4/1994 Kunito ..... 405/241
5,327,980 A * 7/1994 Smet ..... 405/233
5,396,964 A * 3/1995 Shellhorn et al. ..... 175/21
5,411,353 A * 5/1995 Taki ..... 405/241
5,484,233 A * 1/1996 Kunito ..... 405/240
5,570,975 A * 11/1996 Reinert, Sr. ..... 405/232
5,645,376 A * 7/1997 Taki ..... 405/241
6,183,166 B1 * 2/2001 Schellhorn ..... 405/233
6,241,426 B1 * 6/2001 Schellhorn ..... 405/267

* cited by examiner

*Primary Examiner*—Thomas B. Will
*Assistant Examiner*—Tara L. Mayo
(74) *Attorney, Agent, or Firm*—Dorsey & Whitney, LLP

(57) ABSTRACT

A tool for use with a rotatable drill shaft and a source of pressurized fluidized solidifying agent. The tool member has upper and lower extremities. A coupler is coupled to the upper extremity of the tool member and is adapted to be secured to the drill shaft. A plurality of radially extending arms are secured to the tool member intermediate the upper and lower extremities of the tool member. A plurality of forwardly and downwardly extending teeth are secured to each of the radially extending arms and are spaced apart longitudinally of the arms. A plurality of nozzles are carried by the tool member and are spaced circumferentially of the tool member and are coupled to the source of pressurized fluidized solidifying agent.

15 Claims, 3 Drawing Sheets

APPARATUS AND METHOD FOR MAKING CYLINDRICAL COLUMNS

BACKGROUND OF THE INVENTION

This invention relates to a tool and apparatus incorporating the same and a method for constructing cylindrical columns utilizing the tool and forming a wall using the columns.

Columns have heretofore been formed typically by driving a steel casing down into the ground to the appropriate depth and then drilling out the casing. Thereafter, a reinforcing cage or soldier beam is placed in the steel casing and filled with concrete. Thereafter the steel casing is pulled out and used again. Such a procedure is costly and time consuming. There is therefore a need for a new and improved apparatus and method for reducing the time and expense in providing such columns.

BRIEF SUMMARY OF THE INVENTION

In general, it is an object of the present invention to provide a tool and apparatus incorporating the same and a method for constructing cylindrical columns and a wall utilizing the cylindrical columns.

Another object of the invention is to provide a tool and apparatus of the above character which can be utilized for constructing cylindrical columns having a central core of reduced solidifying material.

Another object of the invention is to provide a tool and apparatus of the above character and a method in which the central core of the column can be readily drilled out.

Another object of the invention is to provide a tool, apparatus and method of the above character in which the drilled-out column serves as a form for installing reinforced concrete columns.

Another object of the invention is to provide a tool, apparatus and method of the above character which substantially reduces the cost of the solidifying material utilized in providing a soil mix.

Another object of the invention is to provide a tool, apparatus and method of the above character in which the central core of the soil mix column can be readily drilled out to provide a form for a reinforced concrete column.

Another object of the invention is to provide a tool, apparatus and method of the above character in which reinforced concrete columns can be constructed to form a wall.

Additional objects and features of the invention will appear from the following description in which the preferred embodiment is set forth in conjunction with the accompanying drawings.

DETAILED DESCRIPTION OF THE INVENTION

In general the soil mixing tool for use with the apparatus having a rotatable drill shaft and means for supplying a pressurized fluidized solidifying agent to the drill shaft comprises a tool member having upper and lower extremities. Means is coupled to the upper extremity of the tool member which is adapted to be secured to the drill shaft. A plurality of radially extending arms are secured to the tool member intermediate the upper and lower extremities of the tool member. A plurality of forwardly and downwardly extending teeth are secured to each of the radially extending arms and are spaced apart longitudinally of the arms. A plurality of nozzles are carried by the tool member and are spaced circumferentially of the tool member. The nozzles are spaced radially outwardly from the tool member. Means is provided which is adapted to couple the nozzles to the pressurized fluidized solidifying agent in the drill shaft.

Figure 1:
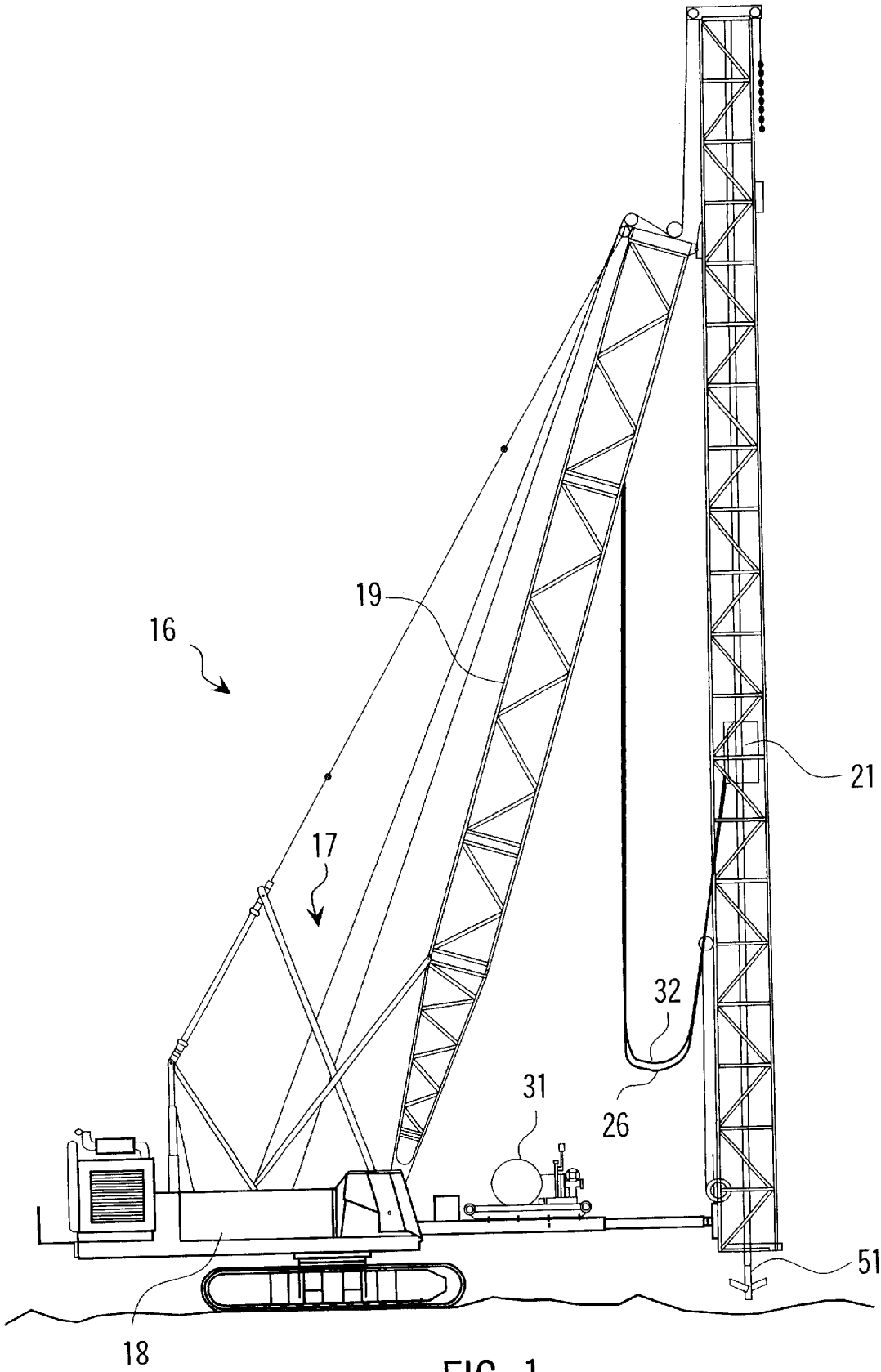
FIG. 1 is a perspective view of an apparatus incorporating the soil mixing tool of the present invention.
Figure 2:
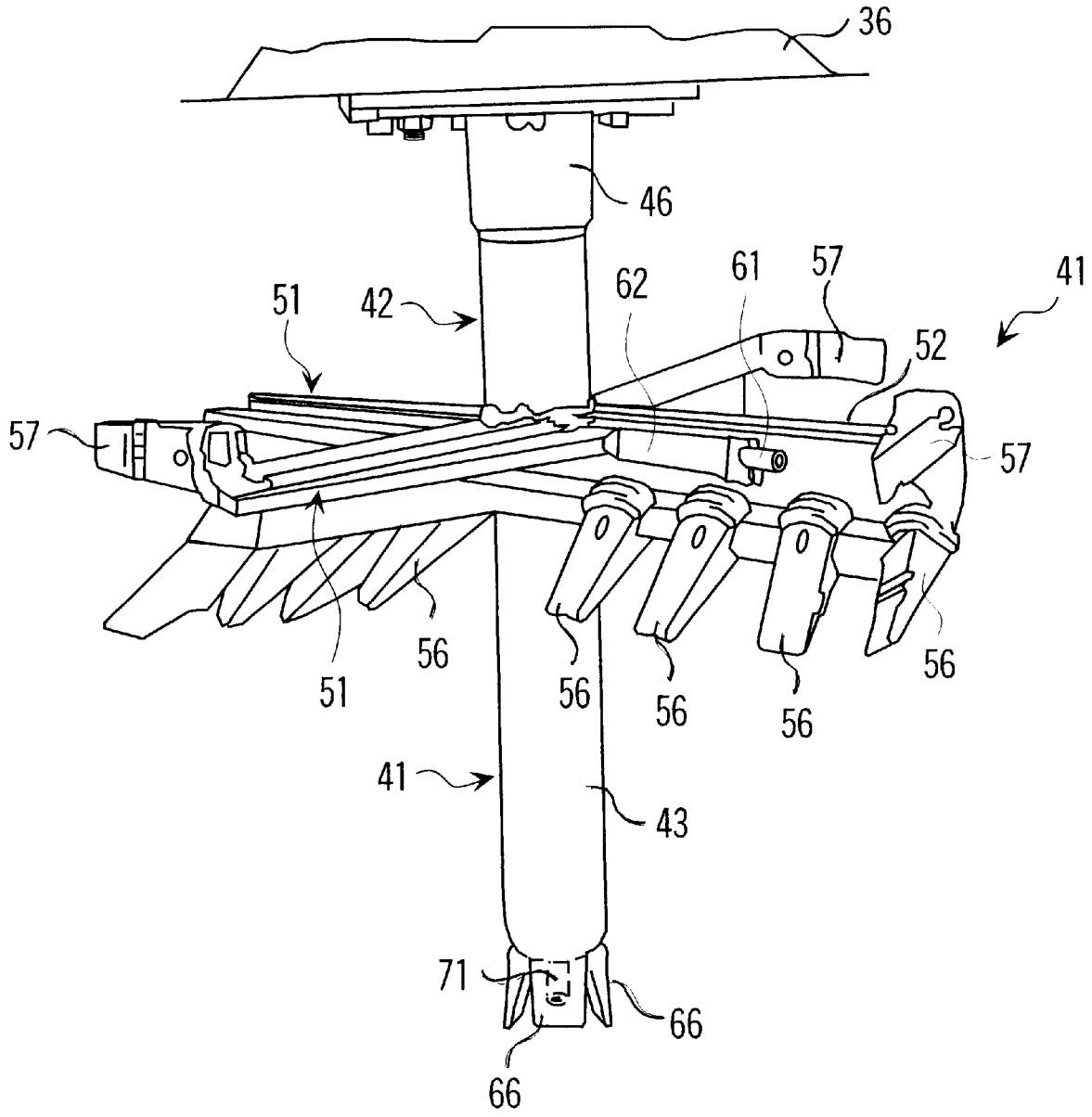
FIG. 2 is a perspective view showing the tool mounted on the apparatus and out of engagement with the soil.
Figure 3:
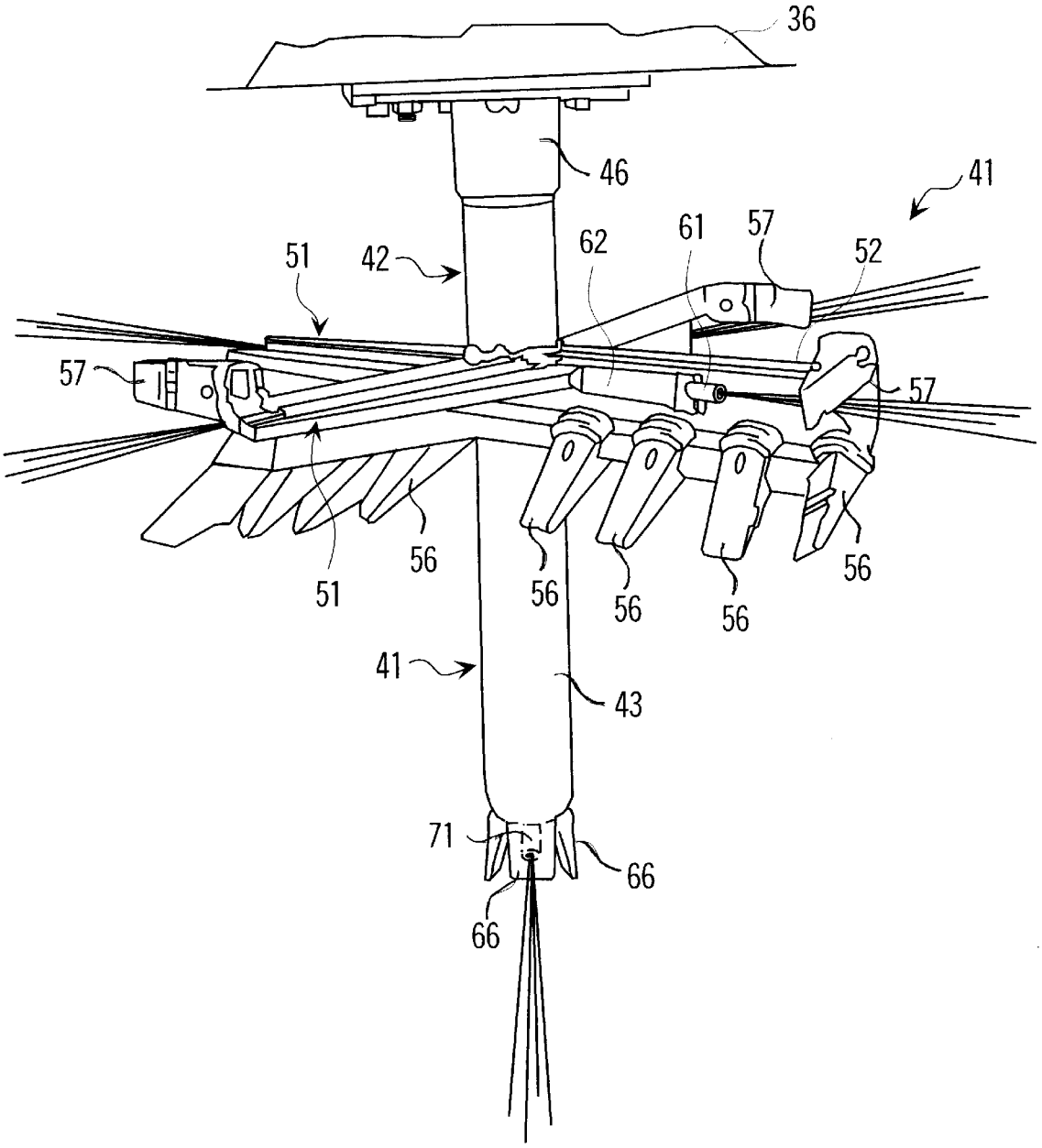
FIG. 3 is another perspective view of the tool out of engagement with the soil and showing jets of solidifying agent exiting from the nozzles of the tool.

More in particular, as shown in FIGS. 1, 2 and 3, the soil mixing tool 11 is shown particularly in FIGS. 2 and 3. This soil mixing tool 11 forms a part of the apparatus 16 shown in FIG. 1. The apparatus 16 is substantially conventional and is comprised of a crane 17 which includes a track laying vehicle 18 which is provided with a lattice=type boom 19. A lattice-type leads 21 is pivotably mounted on the upper extremity of the boom 19. A kelly or drill stem 22 is disposed within the leads 21 and is rotatably mounted therein in a conventional manner as for example by the use of a hydraulic motor (not shown) supplied with hydraulic fluid through a hose 26.

A grout pump 31 is also provided as a part of the apparatus and is utilized for providing a source of pressurized fluidized solidifying material as for example a cementitious material through a hose 32 to the upper extremity of the kelly or drill stem 22 where it enters the center of the hollow drill stem and passes downwardly to the lower extremity of the drill stem. The drill stem 22 passes downwardly through a lower mounting plate 36 forming a part of the leads 21. This drill stem 22 typically is provided with external threads to make a threaded connection with internal threads carried by the soil mixing tool 11 secured thereto as shown in FIGS. 2 and 3.

The soil mixing tool 11 consists of tool member 41 which typically can be cylindrical in form and has the same general size and construction as the drill stem 22. Thus for example, it can have a diameter of approximately 8 inches and with a wall thickness of 1 to 1-½ inches. The tool member 41 is formed of a suitable material such as drill stem steel. The tool member 41 is provided with upper and lower extremities 42 and 43. Means is provided in the form of an internally threaded coupling 46 mounted on the upper extremity 42 and adapted to mate with the external threads (not shown) on a male protrusion carried by the drill stem 22.

A plurality of radially extending arms 51 are mounted on the tool member 41 intermediate the upper and lower extremities and as shown in FIG. 2 are positioned downwardly approximately one-third of the distance from the upper extremity to the lower extremity. These arms are formed of structural steel. In FIG. 2, four of such arms 51 have been provided extending 90° apart and lying generally in the same horizontal plane perpendicular to the vertical axis of the tool member 41. The arms 51 are provided with outer extremities 52.

A plurality of downwardly and forwardly extending digger teeth 56 are secured to each of the arms 51 in longitudinally spaced-apart positions from the forwardmost position of the arms and extending in a clockwise direction on the arms assuming that the tool 41 is rotated in a clockwise direction. Thus, assuming by way of example that the tool has an overall diameter of 54 inches, four of such teeth are spaced apart longitudinally on each of the arms. The construction of the teeth themselves is conventional and will not be described in detail.

An additional tooth 57 similar to the teeth 56 is mounted on the outer extremity 52 of each of the arms 51 and points in a forward, generally horizontal position. The additional teeth 57 serve to define the outer margin of the tool and thereby the outer margin of the hole to be formed by the tool during soil mixing as hereinafter described. The teeth 57 also serve to protect the outer extremities of the arms 51 so they are not worn by movement through the soil during soil mixing activity.

A plurality of nozzles 61 are carried by the tool member and are spaced apart circumferentially of the tool member and are generally disposed in a horizontal plane in front of the arms 51. As shown, the nozzles 61 are mounted immediately adjacent most the forward advancing surface of the arms 51 so that as they travel with the arms they are protected by the arms 51. In accordance with the present invention, the nozzles 61 are spaced outwardly radially from the tool member 41 for reasons hereinafter described. For example in one embodiment of the invention, the outer extremities of the nozzles are positioned so that they are 18 inches outward away from the center of the tool and 9 inches in from the outer margin of the tool. Piping 62 is provided which is connected to each of the nozzles and extends into the interior of the tool member so that it opens into the central bore of the hollow tool member 41 whereby the pressurized fluidized solidifying agent is supplied to each of the nozzles 61.

It should be appreciated in connection with the foregoing that a fewer number or greater number of arms can be provided on such a tool. Although a nozzle has been provided associated with each of the arms, fewer or greater nozzles can be provided if desired.

The lower extremity of the soil mixing tool 11 serves as a pilot for the tool. In order to facilitate downward movement of the lower extremity of the tool member 41, a plurality of downwardly extending fin-shaped blades 66 are secured to the lower extremity 43. For example as shown four of such downwardly extending blades 66 can be provided which are spaced 90° apart and extend radially from the center of the tool member 41. A centrally disposed nozzle 71 is also mounted on the lower extremity 43 centrally of the blades 66 and is directed downwardly along an axis parallel to the center of the longitudinal axis of the tool member 41. This nozzle 71 is also in communication with the interior passageway in the tool member 41 so that it is supplied with the pressurized fluidized solidifying agent hereinbefore described.

Operation and use of the soil mixing tool when incorporated as a part of the apparatus shown in FIG. 1 in performing the method for constructing a cylindrical column having a central core of reduced solidifying agent and a wall made therefrom may now be briefly described as follows. Let it be assumed that the apparatus 16 is in place at the job site and that the tool 11 has been secured to the hollow stem kelly or drill stem 22. Let it also be assumed that the grout pump 31 is in operation and is supplying a pressurized fluidized solidifying agent to the hollow stem kelly.

The soil mixing tool 11 under the control of the operator of the apparatus 16 lowers the tool 11 into engagement with the soil while under controlled rotation. The tool advances downwardly for machined penetration of the soil. The diameter of the machined penetration corresponds to the largest outside dimension of the tool 11 measured perpendicular to the vertical axis of the kelly 22. Prior to, during or after penetration of the tool into the soil, the pressurized fluidized solidifying agent typically in the form of a cement slurry is supplied to the nozzles 61 and 71. Using a cement slurry, the soil-cement column is created in a single nonstop downward pass of the tool. Enough kelly is assembled, based on the deepest column depth required to form the column without stopping to make or break piping connections.

The cement slurry exits from the nozzles in directions shown in FIG. 3 with the jets from the nozzles 61 extending generally in a horizontal plane and with the jet from the nozzle 71 extending downwardly in a vertical direction. This jet from nozzle 71 is utilized to facilitate the lower extremity of the tool member 41 to penetrate the earth and serve as a pilot or guide for the tool as it moves downwardly. Although the cement slurry is delivered to this nozzle 71, in accordance with the present invention this is unnecessary because a water jet could be utilized. The cement slurry jet is utilized because this material is available in the drill stem and is utilized for the other jets from the nozzles. Its use in the central nozzle 71 is undesirable because it wastes cement.

Also in accordance with the present invention, jets of solidifying agent are only introduced into the soil as it is being mixed by the teeth 56 carried by the arms 51 at the outer extremities so that a solidifying agent is not supplied to the mixed soil in the central portion of a mixed soil column. For example, the central 36 inches of a 54 inch column is kept free of the solidifying agent to facilitate removal of the center portion of the mixed soil column. The only solidifying agent received by the center portion is the undesired portion which is discharged from the nozzle 71. Thus, in accordance with the present invention, the slurry is only introduced in the outer margin of the mixed soil column. Thus only the outer 9 inches of the column are treated with the solidifying agent. This solidifying agent in the form of a cement slurry is thoroughly mixed with the in-situ soil. A cement slurry typically has a ratio of one part cement to one part water by weight. The pressure generated by the jets from the nozzles 61 is dissipated into the soil cuttings and mechanically cut by the soil mixing tool 11. However, this pressure is not trapped in the soil because this fluidized soil-cement mix in the outer 9 inch margin constantly overflows to the soil surface during the formation process, preventing ground heave. This combination of mechanical and hydraulic mixing creates an outer margin of the cylindrical soil mix column of fluidized soil-cement. From this it can be seen that the outer margin of the fluidized soil-cement column has an inner margin which is adjacent the sides of the hole which is eventually to be excavated from the soil mix column as hereinafter described as for example a hole of 36 inches in diameter.

Typically a column of this type having a depth of 30 to 35 feet can be prepared using the present invention in a period of approximately 5 minutes for each column. As soon as the desired depth has been reached, the drilling tool is extracted from the soil column because at this point nothing has solidified. Assuming that the column is to form a portion of a wall utilizing the method of the present invention, another mixed soil column is prepared immediately adjacent. For example soil columns having centers can be spaced 48 inches apart to provide approximately 6 inches of overlap. A plurality of these soil mix columns can be formed to provide the basis for a wall of the type hereinafter described. Thus a series of overlapping soil mix columns are provided to in effect provide interlocking soil mix columns extending the entire length of the proposed wall.

After the soil-cement admixture has solidified as for example by the next day, a conventional drilling rig can be utilized having an auger to drill out the centers of the soil mix columns. For example with the 54 inch soil mix columns hereinbefore described, the center 36 inches can be drilled out with the outer 9 inches of a soil mix column which is hardened serving as a form. Also in a conventional manner, a rebar cage or soldier beam inserted into the hole and the hole is filled with concrete to provide a concrete column. If water is encountered, the cylindrical hole can be filled with water to provide a hydrostatic head, a rebar cage can be inserted and the hole filled with Tremie concrete, which procedure is accomplished with respect to all of the soil mix columns. When completed there are provided 36 inch concrete columns separated by 12 inches. Since the soil between the columns has been treated with the cement slurry, a soil-cement is present between the columns which is sufficient to provide a reinforced concrete wall.

From the foregoing it can be seen that there has been provided a soil mixing tool which makes it possible to provide soil mix columns in which the outer margin has been treated with a solidifying agent such as a cement slurry which after hardening the center can be readily drilled out to use the soil-cement outer margin as a form for column construction as hereinbefore described. By not utilizing the cement slurry in the center, there is a substantial reduction in cost saving in cement and in addition, the center is much easier to drill out. Such a method eliminates the use of casings and thus provides a less costly and time saving approach.

What is claimed:

1. A tool for use with a rotatable drill stem and a pressurized source of fluidized solidifying agent comprising a tool member having upper and lower extremities, means coupled to the upper extremity of the tool member and being adapted to be secured to the drill stem, a plurality of radially extending arms secured to the tool member intermediate the upper and lower extremties of the tool member, a plurality of forwardly and downwardly extending teeth secured to each of the radially extending arms and being spaced apart longitudinally of the arms, a plurality of nozzles carried by the tool member and spaced circumferentially of the tool member, said nozzles being spaced radially outwardly from the tool member, and piping carried by the tool member adapted to connect the source of pressurized fluidized solidifying agent to the nozzles.

2. A tool as in claim 1 wherein the piping adapted to couple the nozzles to the source of pressurized fluidized solidifying agent includes a drill stem having a flow passage therein and a tool member which has a flow passage extending from the upper extremity to the lower extremity in communication with the flow passage in the drill stem and piping carried by the tool member connecting the nozzles to the flow passage in the tool member.

3. A tool as in claim 1 further including an additional nozzle mounted on the lower extremity of the tool member and being directed downwardly from the tool member and piping carried by the tool member for supplying a liquid under pressure to the additional nozzle.

4. A tool as in claim 3 further including a plurality of cutting blades mounted on the lower extremity of the tool member, said cutting blades extending radially of the tool member and having outer margins which are generally coincident with the outer margin of the tool member.

5. A tool as in claim 3 wherein said drill stem is hollow and said pressurized fluidized solidifying agent is supplied to the flow passage in the drive stem and wherein the means for coupling the source of fluidized solidifying agent to the nozzles and the additional nozzle includes piping connecting the nozzles to the flow passage in the drill stem.

6. A tool as in claim 1 wherein the radially extending arms are provided with outer extremities and further including a forwardly extending tooth mounted on the outer extremity and serving to define the outer margin of the soil mixing tool and serving to protect the outer extremity of the arms from wear.

7. An apparatus for providing soil mix columns, a crane carrying a hollow drill stem having a flow passage therein, a grout pump, piping for supplying pressurized fluidized solidifying agent from the grout pump to the flow passage in the drill stem, a soil mixing tool secured to the drill stem, said soil mixing tool comprising a tool member having upper and lower extremities, a coupling connecting the upper extremity of the tool member to the drill stem, a plurality of radially extending arms secured to the tool member intermediate the upper and lower extremities, a plurality of forwardly and downwardly extending teeth secured to each of the radially extending arms and spaced apart longitudinally of the radially extending arms, a plurality of nozzles carried by the tool member and spaced apart circumferentially of the tool member, said nozzles being spaced radially outwardly from the tool member and piping coupling the nozzles to the flow passage in the drill stem for supplying pressurized fluidized solidifying agent to the nozzles.

8. Apparatus as in claim 7 further including cutting blades secured to the lower extremity of the tool member and extending radially of to tool member and having outer margins generally in line with the outer surface of the tool member and a downwardly facing nozzle secured to the lower extremity and piping coupling the downwardly facing nozzle to the flow passage in the drill stem.

9. A method for forming at least one soil mix column in soil comprising the steps of progressively mixing in a single downward pass a cylindrical volume of the soil in situ to provide a cylindrical volume of soil having a central portion and an outer margin and supplying a pressurized and fluidized solidifying agent into the cylindrical volume of soil while it is being mixed in such a manner that the fluidized solidifying agent is only delivered into the outer margin of the cylindrical volume of soil and leaving the central portion of the cylindrical volume of soil substantially free of the fluidized solidifying agent.

10. A method as in claim 9 further including the step of permitting the mixture of the solidifying agent and the soil to harden and thereafter drilling out the soil in the central portion of the cylindrical volume of soil to provide a hole disposed within the hardened outer margin of he cylindrical volume of soil whereby the outer margin of the cylindrical volume of soil serves as a form.

11. A method as in claim 10 further including the step of inserting reinforcing into the hole and filling the hole with concrete.

12. A method as in claim 10 further including the steps of forming a series of soil mix columns which are in close proximity to each other.

13. A method as in claim 12 wherein the soil mix columns are formed so that adjacent portions of the soil mix columns overlap.

14. A method as in claim 13 further including the step of removing the soil from the central portions of the soil mix columns to form a plurality of holes.

15. A method as in claim 14 further including the step of inserting reinforcing members into the plurality of holes formed in the soil mix columns and filling the holes with concrete to form at least a portion of a wall.

* * * * *